US008903264B2

(12) United States Patent
Fujioka

(10) Patent No.: US 8,903,264 B2
(45) Date of Patent: Dec. 2, 2014

(54) IMAGE FORMING APPARATUS CONFIGURATION FOR ELECTRIC CHARGE REMOVAL

(71) Applicant: Michio Fujioka, Nagoya (JP)

(72) Inventor: Michio Fujioka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/836,194

(22) Filed: Mar. 15, 2013

(65) Prior Publication Data

US 2014/0003834 A1 Jan. 2, 2014

(30) Foreign Application Priority Data

Jun. 29, 2012 (JP) ..... 2012-146553

(51) Int. Cl.
*G03G 15/00* (2006.01)
*G03G 15/01* (2006.01)

(52) U.S. Cl.
USPC ..... 399/90; 399/303

(58) Field of Classification Search
CPC ..... G03G 15/16; G03G 15/167; G03G 2215/0138; G03G 2215/0141; G03G 2215/0145; G03G 2215/0148
USPC ..... 399/90, 303, 312
See application file for complete search history.

(56) References Cited

U.S. PATENT DOCUMENTS

| | | | | | |
|---|---|---|---|---|---|
| 5,966,560 | A | * | 10/1999 | Kodama et al. | 399/66 |
| 6,144,831 | A | | 11/2000 | Takenouchi et al. | |
| 7,590,375 | B2 | * | 9/2009 | Iwata | 399/302 |
| 8,477,470 | B2 | * | 7/2013 | Kurosu et al. | 361/212 |

FOREIGN PATENT DOCUMENTS

| | | | | |
|---|---|---|---|---|
| JP | 08-166733 | A | | 6/1996 |
| JP | 08-194387 | A | | 7/1996 |
| JP | 10063113 | A | * | 3/1998 |
| JP | 10-171262 | A | | 6/1998 |
| JP | 11-305559 | A | | 11/1999 |
| JP | 2000-293046 | A | | 10/2000 |
| JP | 2001-066904 | A | | 3/2001 |
| JP | 2003280400 | A | * | 10/2003 |
| JP | 2004-109875 | A | | 4/2004 |
| JP | 2009-294555 | A | | 12/2009 |
| JP | 2011107535 | A | * | 6/2011 |

* cited by examiner

*Primary Examiner* — Robert Beatty
(74) *Attorney, Agent, or Firm* — Banner & Witcoff, Ltd.

(57) ABSTRACT

An image forming apparatus includes a first roller and a second roller spaced apart from the first roller, a belt being endless and extending around the first roller and the second roller, a photosensitive member, a transfer member, and a conductor. The belt is configured to move in a moving direction. The belt has a first surface and a second surface. The first surface extends from the first roller to the second roller in the moving direction, and the second surface extends from the second roller to the first roller in the moving direction. The photosensitive member is disposed facing the first surface of the belt and configured to carry a developer image thereon. The transfer member is disposed facing toward the photosensitive member and configured to transfer the developer image on the photosensitive member. The conductor is electrically grounded and disposed facing the second surface of the belt.

10 Claims, 6 Drawing Sheets

IMAGE FORMING APPARATUS CONFIGURATION FOR ELECTRIC CHARGE REMOVAL

CROSS REFERENCE TO RELATED APPLICATION

This application claims priority from Japanese Patent Application No. 2012-146553, filed on Jun. 29, 2012, which is incorporated herein by reference in its entirety.

FIELD

Aspects of the disclosure relate to an image forming apparatus including a belt.

BACKGROUND

Generally, known electrophotographic image forming apparatuses include two types: a direct tandem type where toner images carried on photosensitive drums are directly transferred onto a sheet fed on a conveyor sheet; and an intermediate transfer type where toner images carried on photosensitive drums are transferred onto an intermediate transfer belt and then transferred from the intermediate transfer belt onto a sheet.

A known intermediate transfer type image forming apparatus is configured to form an image on a sheet by transferring a toner image formed on an intermediate transfer belt onto the sheet. During toner image transferring onto the sheet, electric charges may remain on a surface of the sheet. As the electric charges may cause undesired electrostatic discharge between the intermediate transfer belt and the sheet, a method for removing electric charges from a surface of a sheet has been proposed.

SUMMARY

According to a study of the inventor of the disclosure, it has been found that electric charges may remain also on a conveyor belt or an intermediate transfer belt, and cause electrostatic discharge when a sheet comes off from the belt. Due to the electrostatic discharge, a toner image not yet fixed on the sheet may result in a blurred image and the belt surface may be damaged, e.g., scratched.

Illustrative aspects of the disclosure provide an image forming apparatus configured to remove electric charges from a surface of a belt effectively.

According to an aspect of the disclosure, an image forming apparatus includes a first roller and a second roller spaced apart from the first roller, a belt being endless and extending around the first roller and the second roller, a photosensitive member, a transfer member, and a conductor. The belt is configured to move in a moving direction. The belt has a first surface and a second surface. The first surface extends from the first roller to the second roller in the moving direction, and the second surface extends from the second roller to the first roller in the moving direction. The photosensitive member is disposed facing the first surface of the belt and configured to carry a developer image thereon. The transfer member is disposed facing toward the photosensitive member and configured to transfer the developer image on the photosensitive member. The conductor is electrically grounded and disposed facing the second surface of the belt.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. In the following description, a general structure of a color LED printer 1, as an example of an image forming apparatus, will be described and then features of the disclosure will be described in detail.

In the following description, orientations or sides of the color LED printer 1 will be identified based on the color LED printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top-bottom direction may be referred to as a vertical direction.

Figure 1:
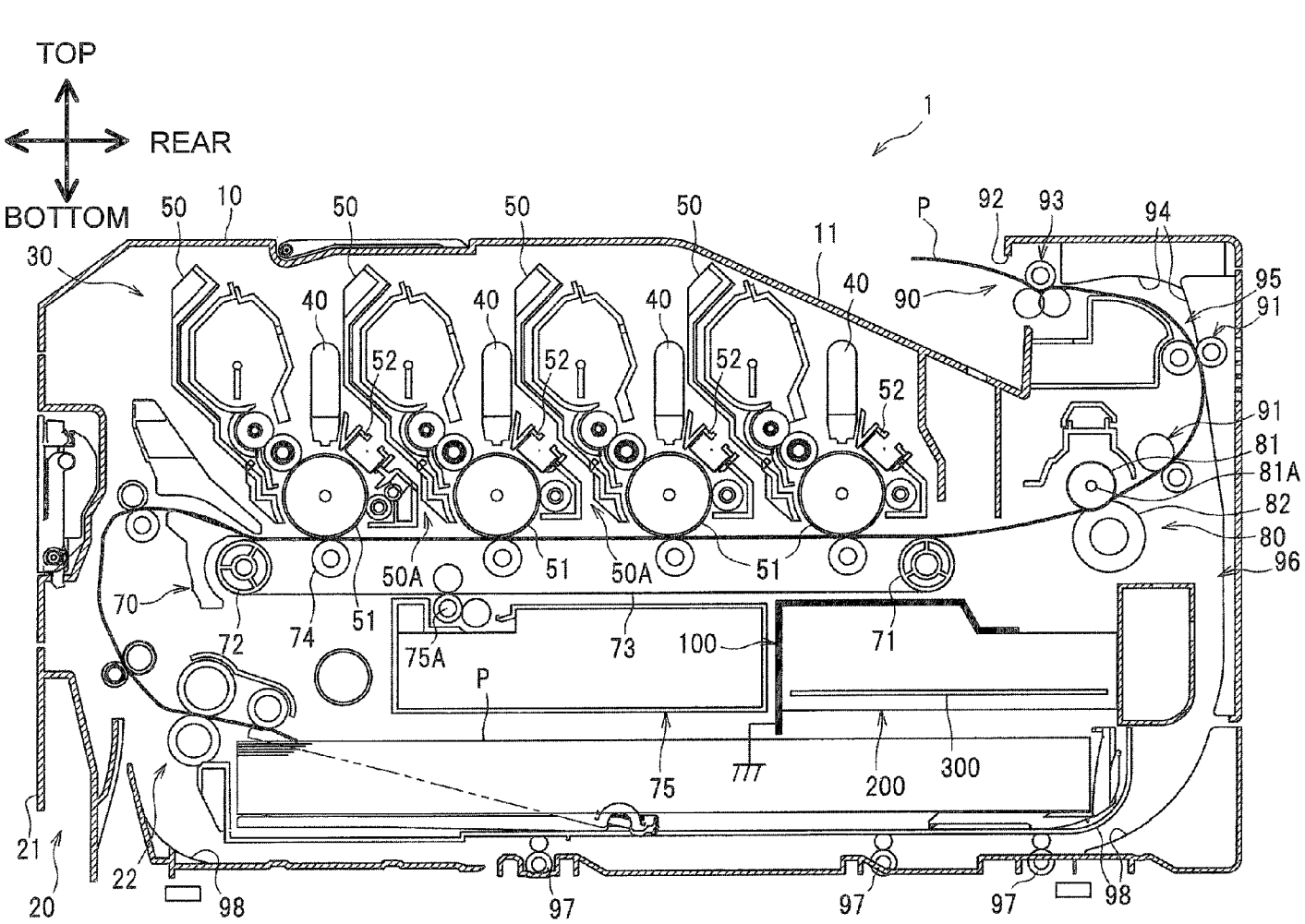
FIG. 1 is a sectional view of an illustrative image forming apparatus, e.g. a color LED printer, according to an embodiment of the disclosure.

As shown in FIG. 1, the color LED printer 1 includes a main body 10, a sheet feed portion 20 configured to feed a sheet P, as an example of a recording sheet, an image forming portion 30 configured to form an image on the sheet P fed thereto, and a sheet ejection portion 90 configured to eject the sheet P having the image formed thereon.

The sheet feed portion 20 is disposed below the image forming portion 30, and includes a sheet tray 21 configured to accommodate sheets P therein, and a sheet feeding device 22 configured to feed a sheet P from the sheet tray 21 to the image forming portion 30. In the sheet feed portion 20, the sheet feeding device 22 feeds a sheet P from the sheet tray 21 to the image forming portion 30 in the shape of a letter U from the front side to the rear side.

The image forming portion 30 includes four LED units 40, four process cartridges 50, a transfer unit 70 and a fixing unit 80.

Each of the LED units 40 includes a plurality of LEDs and is configured to irradiate a photosensitive drum 51 as an example of a photosensitive member.

The process cartridges 50 are arranged in the front-rear direction and each include a photosensitive drum 51, a charger 52, a known developing roller and a known toner chamber which are unnumbered.

The transfer unit 70 is disposed between the sheet feed portion 20 and each of the process cartridges 50, and includes a drive roller 71 as an example of a first roller, a driven roller 72 as an example of a second roller, a conveyor belt 73 as an example of a belt, and transfer rollers 74 as an example of a transfer member.

The drive roller 71 and the driven roller 72 are spaced apart from and parallel to each other in the front-rear direction, and the conveyor belt 73, which is an endless belt, is stretched therebetween. The drive roller 71 is located downstream relative to the photosensitive drums 51 in a moving direction of the conveyor belt 73. The conveyor belt 73 contacts the photosensitive drums 51 at its outer surface. Inside the conveyor belt 73, four transfer rollers 74 are disposed facing toward the photosensitive drums 51 such that the endless belt 73 is sandwiched between the transfer rollers 74 and the photosensitive drums 51. During image transfer, the transfer rollers 74 are biased.

The conveyor belt 73 10 is made of a resistive element, e.g., a nylon resin, having a volume resistivity ten to the power of eleven to thirteen (ohm-centimeter), and can prevent leakage of current from the transfer rollers 74, which are disposed inside the conveyor belt 73. Thus, electric charges are liable to build up on a surface of the conveyor belt 73.

The transfer unit 70 is disposed above a cleaning unit 75 as an example of a cleaning member and a board container 200 including a conductor plate 100, as an example of a conductor, disposed proximate to the conveyor belt 73.

The cleaning unit 75 includes a cleaning roller 75A and is configured to collect foreign matter adhering to the conveyor belt 73 such as toner and paper dust.

The cleaning roller 75A is disposed in contact with the conveyor belt 73 and configured to remove foreign matter adhering to the conveyor belt 73 therefrom.

The board container 200 is disposed rearward of the cleaning unit 75 or upstream from the cleaning unit 75 in the moving direction of the conveyor belt 73 and accommodates a circuit board 300 inside.

The fixing unit 80 is disposed at the rear of the process cartridges 50 and the transfer unit 70, and includes a heat roller 81 having a heat source, e.g., a halogen heater 81A inside, and a pressure roller 82 disposed opposite to the heat roller 81 and configured to press the heat roller 81A.

In the image forming portion 30 structured as described above, the surface of each photosensitive drum 51 is uniformly charged by a corresponding charger 52, and subsequently exposed by a corresponding LED unit 40. Thus, a potential in an exposed area of each photosensitive drum 51 drops, and an electrostatic latent image based on image data is formed on the surface of each photosensitive drum 51. Then, the developing roller supplies toner to the electrostatic latent image formed on each photosensitive drum 51, and a toner image is carried on the surface of each photosensitive drum 51.

Then, when a sheet P is supplied onto the conveyor belt 73 and fed in between the photosensitive drum 51 and the transfer rollers 74, the toner images carried on the surfaces of the photosensitive drums 51 are sequentially transferred onto the sheet P. The sheet P having the toner images transferred thereto passes between the heat roller 81 and the pressure roller 82 and the toner images transferred onto the sheet P are thermally fixed.

The sheet ejection portion 90 includes a feed roller 91, an ejection roller 93, and a guide 94. The feed roller 91 is configured to feed a sheet P. The ejection roller 93 is configured to eject the sheet P from an ejection port 92 outside of the main body 10 (or to a sheet ejection tray 11). The ejection port 92 is provided in the main body 10 such that it is open frontward above the fixing unit 80. The guide 94 is configured to guide the sheet P from the fixing unit 80 toward the ejection port 92 in the shape of a letter U. The feed roller 91, the ejection roller 93 and the guide 94 define a U-shaped sheet ejection path 95 through which the sheet P printed in the image forming portion 30 is guided outside of the main body 10.

The sheet ejection path 95 is coupled to a re-feed path 96 for re-feeding the sheet P from the sheet ejection path 95 to an upstream side of the image forming portion 30 in the sheet feed direction to print the back side (e.g., a reverse side) of the sheet P. The re-feed path 96 is defined by multiple re-feed rollers 97 and a guide 98.

In the sheet ejection portion 90, during simplex printing, a sheet P having passed through the fixing unit 80 is fed in the sheet ejection path 95 frontward from the rear side in the U shape, and ejected via the ejection port 92 to the ejection tray 11 outside of the main body 10. On the other hand, during duplex printing, after a sheet P whose single side has been printed is ejected halfway from the main body 10 by the ejection roller 93, the ejection roller 93 rotates backward and the sheet P is delivered to the re-feed path 96 and re-fed to the upstream side of the image forming portion 30 with its front side and the back side reversed.

The following will describe a structure of the conductor plate 100.

Figure 2:
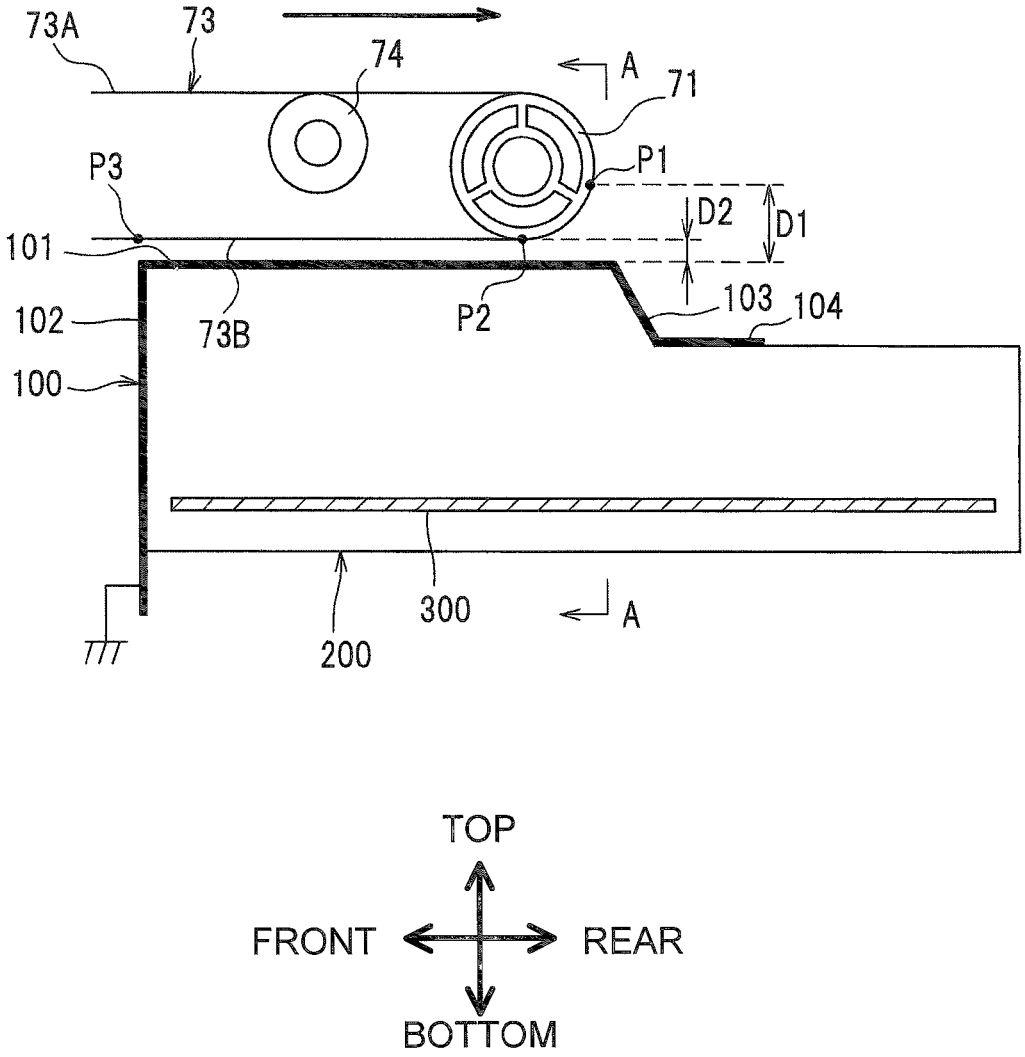
FIG. 2 is an enlarged view of a conductor plate and its peripheral components.

As shown in FIG. 2, the conductor plate 100 has an electric charge removing surface 101, a ground surface 102, an inclined surface 103, and a rear end surface 104. These surfaces are located below the conveyor belt 73 and define an upper surface and a front surface of the board container 200. The conductor plate 100 is made of a sheet of metal to shape the above surfaces by sheet metal working.

The electric charge removing surface 101 is disposed facing an extension surface 73B, as an example of a second surface, of the conveyor belt 73 in parallel thereto. The extension surface 73B is located downstream relative to the drive roller 71 in the moving direction, which is indicated by an arrow, of the conveyor belt 73, and opposite to a sheet conveying surface 73A, as an example of a first surface, of the conveyor belt 73 on which a sheet P is conveyed. The electric charge removing surface 101 extends frontward of the most downstream-side transfer roller 74 and is shaped to have a plate shape. In other words, the electric charge removing surface 101 faces the conveyor belt 73 widely.

The electric charge removing surface 101 and the conveyor belt 73 wound around the drive roller 71 are disposed such that a distance therebetween gets shorter at a downstream portion of the drive roller 71, in the moving direction of the conveyor belt 73, than at an upstream portion of the drive roller 71. Specifically, the conveyor belt 73 starts to face the electric charge removing surface 101 from when coming to a position P1 where a distance from the surface of the conveyor belt 73 to the electric charge removing surface 101 becomes D1. As the conveyor belt 73 moves along with an outer surface of the drive roller 71 toward the downstream side in the moving direction of the conveyor belt 73, the surface of the conveyor belt 73 having come to the position P1 gradually approaches the electric charge removing surface 101, and reaches a position P2 where the conveyor belt 73 comes closest to the electric charge removing surface 101 and the distance becomes D2. Thus, as the surface of the conveyor belt 73 approaches the electric charge removing surface 101 not suddenly but gradually, localized electric discharge can be prevented. D2 is in the range of 1 to 10 mm, specifically 2 to 4 mm.

The surface of the conveyor belt 73 having reached the position P2 further moves to a position P3 where the surface of the conveyor belt 73 approaches a front end portion of the electric charge removing surface 101. A distance from the position P2 to the position P3 is fully longer than a distance from the position P1 to the position P2, and thus the surface of the conveyor belt 73 is allowed to remain close to the electric charge removing surface 101 sufficiently for a long time. Thus, electric charges can be effectively removed.

The ground surface 102 constitutes a front surface of the board container 200, and is shaped to extend from the front end portion of the electric charge removing surface 101 downward of the board container 200. A lower end portion of the ground surface 102 is electrically grounded.

The inclined surface 103 is shaped such that it is inclined rearward and downward from a rear end portion of the electric charge removing surface 101 located rearward of the drive roller 71.

The rear end surface 104 is shaped to extend slightly rearward from an end of the inclined surface 103 opposite to the electric charge removing surface 101.

A structure of the conductor plate 100 in the vicinity of the drive roller 71 will be described.

Figure 3:
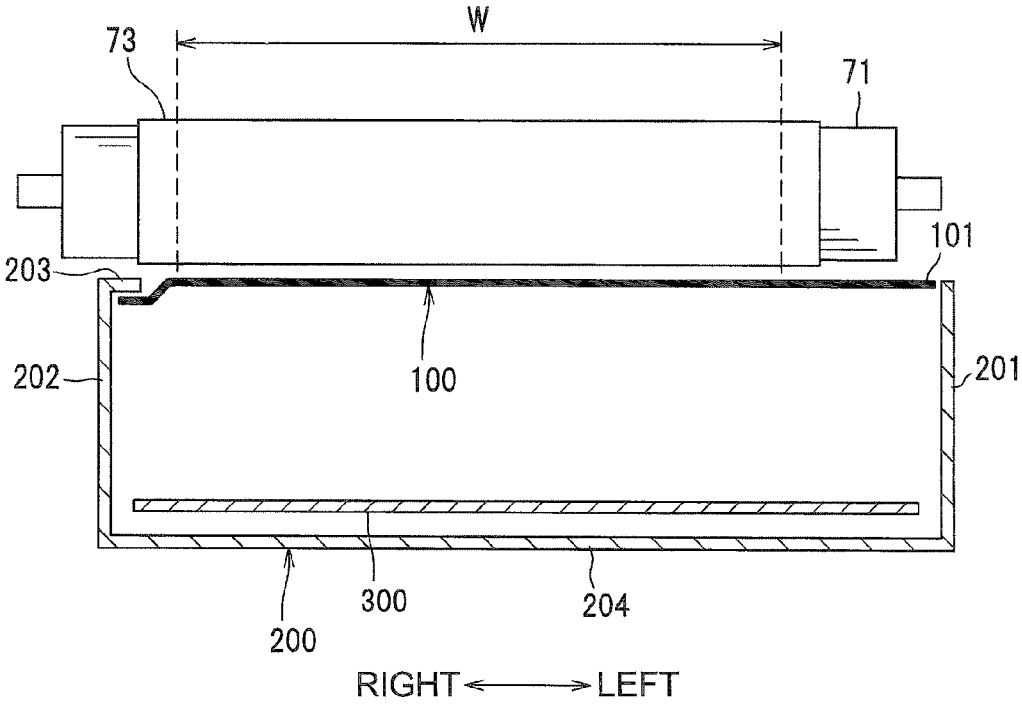
FIG. 3 is a sectional view taken along the line A-A of FIG. 2.

The board container 200 is made of a metal plate. As shown in FIG. 3, the board container 200 includes a left sidewall 201, a right sidewall 202, an upper wall 203 and a lower wall 201 in addition to the conductor plate 100.

The left sidewall 201 is located leftward of a left end of the drive roller 71 (on the right side in FIG. 3).

The right sidewall 202 is located in a position corresponding to a right end portion of the drive roller 71 (on the left side in FIG. 3), and is connected to the upper wall 203.

The upper wall 203 is shaped such that it is located outside of an image formation zone width W on the conveyor belt 73 or a width where a toner image is to be formed.

The electric charge removing surface 101 is disposed at a substantially same height as a surface of the upper wall 203 approximate to the drive roller 71. A left end portion of the electric charge removing surface 101 extends leftward of the left end of the drive roller 71 and is disposed in proximity to the left sidewall 201 of the board container 200. A right end portion of the electric charge removing surface 101 is disposed such that it seats below the upper wall 203 of the board container 200. In other words, the electric charge removing surface 101 is disposed in the image formation zone width W of the conveyor belt 73. As both left and right end portions of the electric charge removing surface 101 are disposed outside of the conveyor belt 73 in a width direction thereof, localized electric discharges at both end portions of the electric charge removing surface 101 can be prevented.

The following will describe electric charge removing operation.

Figure 4A:
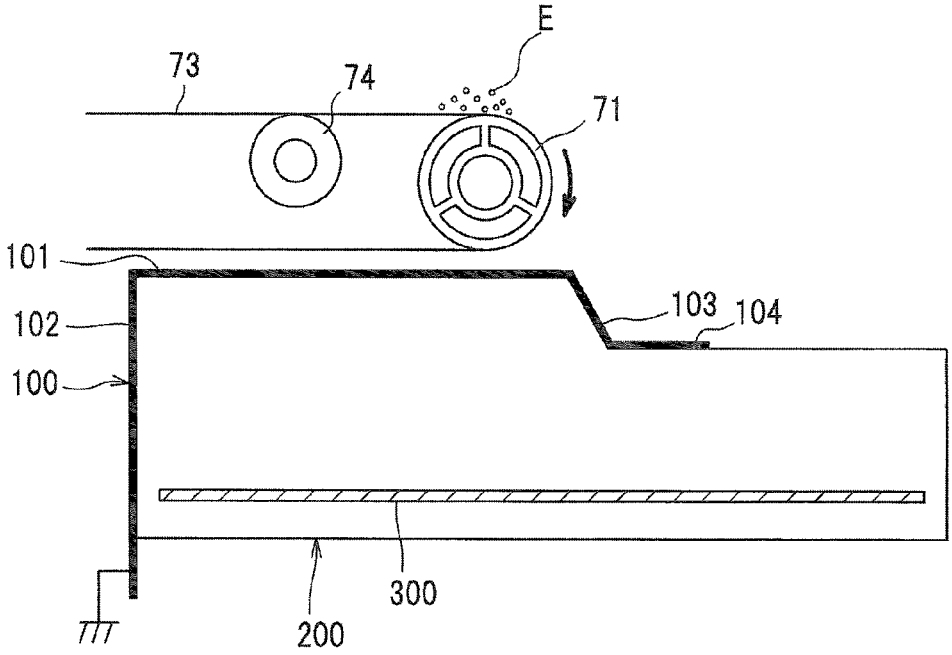
FIG. 4A is an enlarged view of the conductor plate and its peripheral components before electric charges are removed from the conductor plate.

As shown in FIG. 4A, electric charges E built up on the surface of the conveyor belt 73 move along with the movement of the conveyor belt 73.

As the conveyor belt 73 moves from the drive roller 71 toward the downstream side in the moving direction of the conveyor belt 73, the electric charges E on the surface of the conveyor belt 73 gradually approach the electric charge removing surface 101 of the conductor plate 100.

Figure 4B:
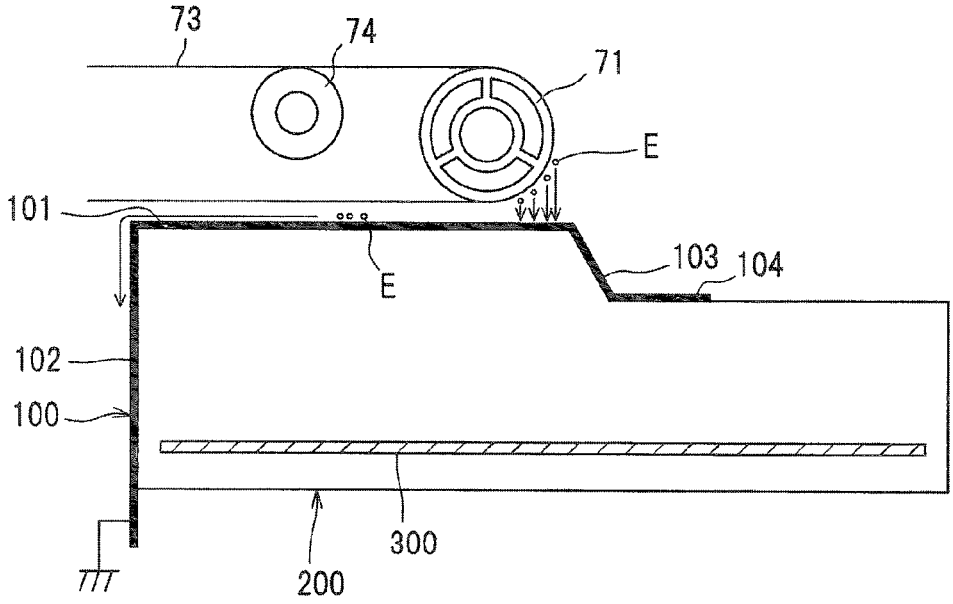
FIG. 4B is an enlarged view of the conductor plate and its peripheral components while electric charges are removed from the conductor plate.

As shown in FIG. 4B, as the surface of the conveyor belt 73 approaches the electric charge removing surface 101, the electric charges E move from the surface of the conveyor belt 73 to the electric charge removing surface 101, and are removed via the ground surface 102 electrically grounded. In this way, the electric charges E on the surface of the conveyor belt 73 are immediately removed.

The color LED printer 1 according to the embodiment is configured to remove electric charges from the surface of the conveyor belt 73 via the conductor plate 100, because the conductor plate 100 is disposed in proximity to the surface of the conveyor belt 73 and is electrically grounded. With this structure, electric charges can be effectively removed from the surface of the conveyor belt 73. Thus, a buildup of electric charges on the surface of the conveyor belt 73 can be reduced.

The conductor plate 100 faces the extension surface 73B of the conveyor belt 73 different from the sheet conveying surface 73A. In the direct tandem type, electric charges can be removed from the conveyor belt 73 quickly after a sheet P comes off from the conveyor belt 73. In addition, similar effects can be obtained even when a sheet P, which is re-fed from the re-feed path 96 and is hard to absorb electric charges, comes off from the conveyor belt 73. Thus, a buildup of the electric charges on the conveyor belt 73 can be effectively reduced.

The conveyor belt 73 and the electric charge removing surface 101 are configured such that the surface of the conveyor belt 73 gradually approaches the electric charge removing surface 101 as the conveyor belt 73 moves from the drive roller 71 toward the downstream side in the moving direction of the conveyor belt 73. Thus, the surface of the conveyor belt 73 wound around the drive roller 71 does not suddenly approach the end portion of the electric charge removing surface 100. This configuration can prevent an occurrence of a localized large electrostatic discharge.

The conductor plate 100 is disposed along the extension surface 73B of the conveyor belt 73, which extends downstream of the drive roller 71 in the moving direction of the conveyor belt 73. As the conductor plate 100 is shaped to have a plate shape, the conductor plate 100 is disposed facing the conveyor belt 73 widely. Thus, electric charges can be effectively removed from the conveyor belt compared with a case where the conductor plate does not face the conveyor belt widely.

As the width of the conductor 100 is wider than the image formation zone width W on the surface of the conveyor belt 73, the conductor plate 100 can be disposed in a range on the conveyor belt 73 corresponding to the image formation zone. Thus, electric charges can be effectively removed from the range corresponding to the image formation zone.

The conductor plate 100 constitutes a part of the board container 200, and thus the conductor plate 100 being grounded can be used for reducing noise from the circuit board 300 as well as for removing electric charges from the conveyor belt 73. Thus, compared with a structure where the conductor plate is used alone, the need to increase the manufacturing cost and the physical size of the color LED printer 1 can be obviated.

As the conductor plate 100 is disposed upstream of the cleaning roller 75A in the moving direction of the conveyor belt 73, electric charges can be removed from the conveyor belt 73 before the cleaning roller 75A cleans the conveyor belt 73. Thus, the cleaning roller 75A is likely to be insensitive to electric charges and effective cleaning can be obtained.

The above embodiment shows, but is not limited to, that the color LED printer 1 is of a direct tandem type. For example, the embodiment may be applied to an intermediate transfer type image forming apparatus, which includes an endless intermediate transfer belt, a pair of rollers around which the intermediate transfer belt extends, and a transfer member, which is disposed opposite to a photosensitive member on which a developer image is to be formed and configured to transfer the developer image on the photosensitive member to the intermediate transfer belt. According to this structure, the conductor plate may be disposed in proximity to the intermediate transfer belt and be electrically grounded, and effects similar to those brought about by the embodiment can be appreciated. The above embodiment shows, but is not limited to, that the belt extends around two rollers. The belt may extend around three or more rollers.

The above embodiment shows, but is not limited to, that the conductor plate 100 is disposed in a range corresponding to the image formation zone width W of the conveyor belt 73. A conductor plate having a width wider than that of the conductor belt 73 may be disposed. According to this structure, the conductor plate can be disposed over all width of the conveyor belt 73 and thus electric charges can be effectively removed from the conveyor belt 73.

Figure 5:
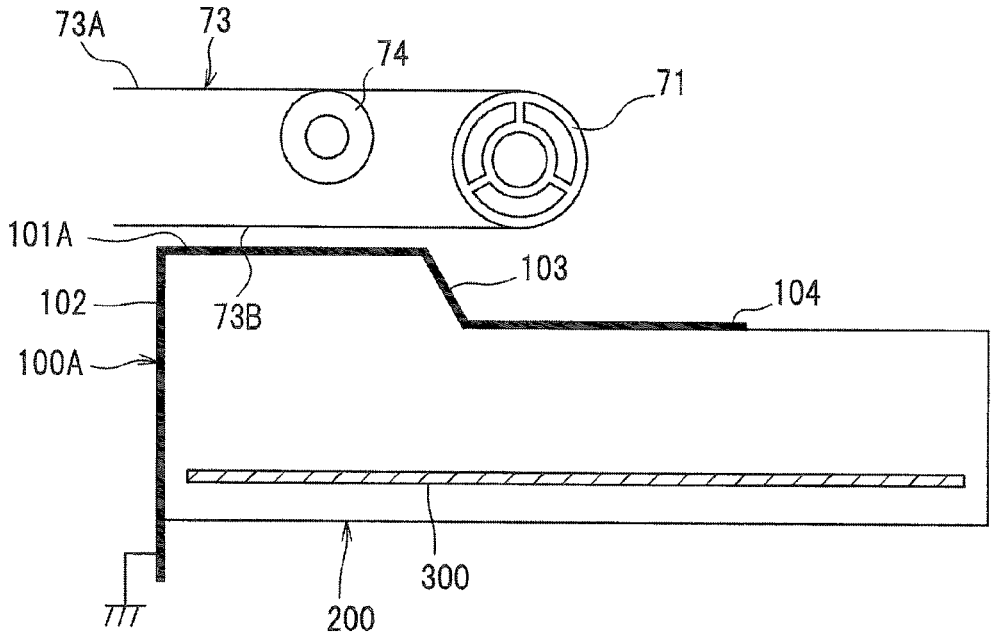
FIG. 5 is an enlarged view of a conductor plate and its peripheral components according to a first modification of the disclosure.

The above embodiment shows, but is not limited to, that the conveyor belt 73 is disposed such that the surface of the conveyor belt 73 wound around the drive roller 71 gradually approaches the electric charge removing surface 101 as the conveyor belt 73 moves from the drive roller 71 toward the downstream side in the moving direction of the conveyor belt 73. As shown in FIG. 5, an electric charge removing surface 100A may be disposed such that the extension surface 73B of the conveyor belt 73 approaches the electric charge removing surface 101A in a position where the electric charge removing surface 101A does not overlap the drive roller 71 as viewed from a top-bottom direction.

The above embodiment shows, but is not limited to, that the conductor plate 100 constitutes a part of the board container 200. The conductor plate 100 may be provided as an independent component or constitute a part of a member except for the board container.

The above embodiment shows, but is not limited to, that the conductor plate 100 includes the electric charge removing surface 101, the ground surface 102, the inclined surface 103, and the rear end surface 104. The conductor plate may have any shape such that it may only have an electric charge removing surface, which is grounded.

Figure 6:
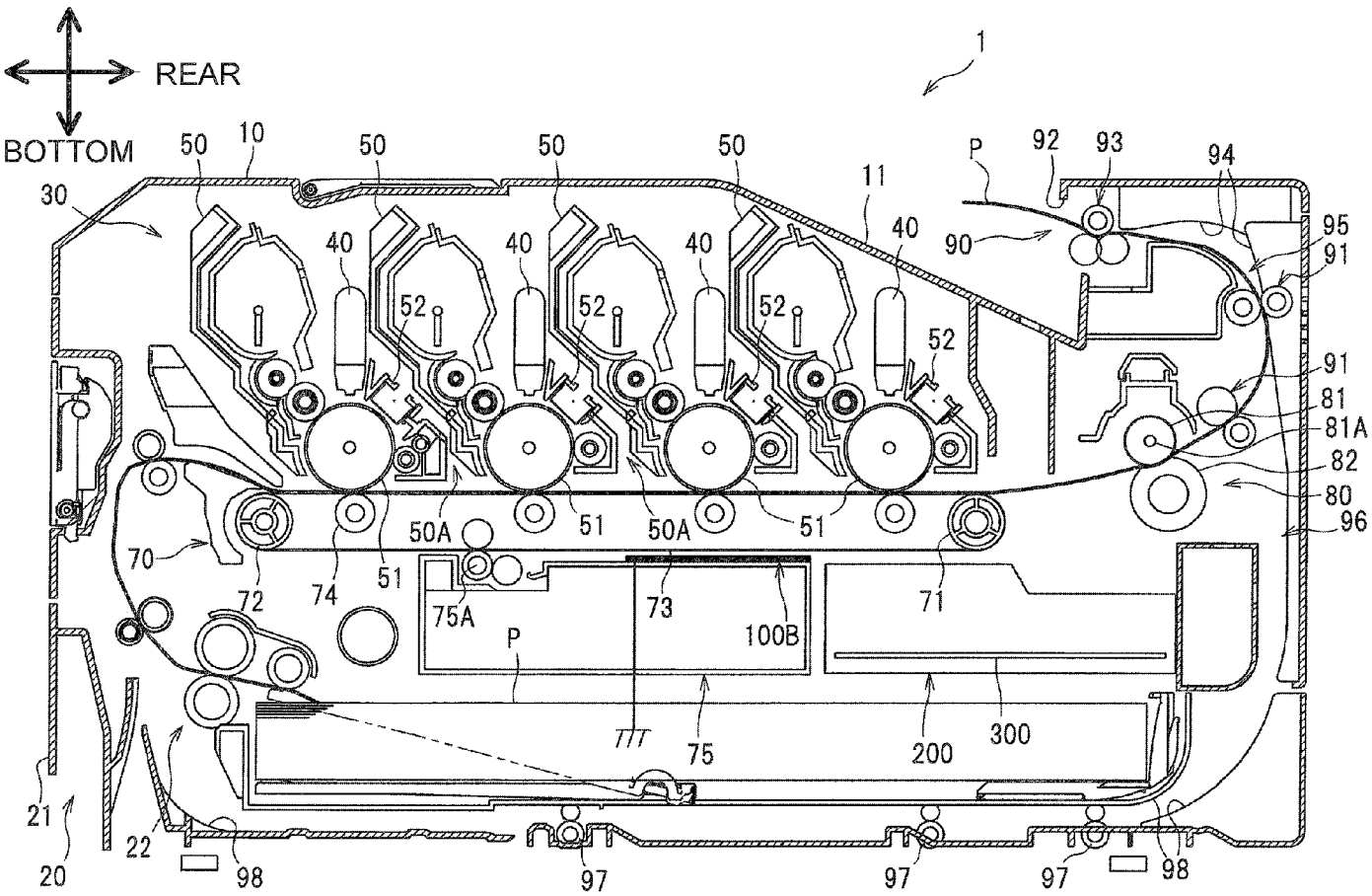
FIG. 6 is a sectional view of a color LED printer including a conductor plate according to a second modification of the disclosure.

The above embodiment shows, but is not limited to, that the conductor plate 100 is disposed upstream of the cleaning unit 75 in the moving direction of the conveyor belt 73. As shown in FIG. 6, for example, a conductor plate 100B, which is electrically grounded, may be disposed in the cleaning unit 75 such that the conductor plate 100B faces the surface of the conveyor belt 73.

The above embodiment shows, but is not limited to, the color LED printer 1 as an electrophotographic image forming apparatus according to aspects of the disclosure. The image forming apparatus may include an exposure device using a laser scanner. The image forming apparatus may include a copier, a multifunction apparatus and other apparatus.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

a first roller and a second roller spaced apart from the first roller;

a belt being endless and extending around the first roller and the second roller, the belt being configured to move in a moving direction, the belt having a first surface and a second surface, the first surface extending from the first roller to the second roller in the moving direction, the second surface extending from the second roller to the first roller in the moving direction;

a photosensitive member disposed facing the first surface of the belt and configured to carry a developer image thereon;

a transfer member disposed facing toward the photosensitive member and configured to transfer the developer image on the photosensitive member; and a conductor electrically grounded and disposed facing the second surface of the belt and facing toward the second roller, wherein the conductor and the belt extending around the second roller are disposed with a distance therebetween that is shorter at a downstream portion of the second roller in the moving direction of the belt than at an upstream portion of the second roller.

2. The image forming apparatus according to claim 1, wherein the conductor is disposed along the second surface of the belt and has a plate shape.

3. The image forming apparatus according to claim 1, wherein the conductor has a width wider than a width of an image forming zone on the belt.

4. The image forming apparatus according to claim 1, wherein the belt is configured to feed a recording sheet on the first surface.

5. The image forming apparatus according to claim 4, further comprising:

a fixing unit configured to thermally fix the developer image transferred from the photosensitive member onto the recording sheet; and a re-feeding mechanism configured to feed the recording sheet having passed through the fixing unit again to the photosensitive member.

6. The image forming apparatus according to claim 1, further comprising a cleaning member configured to remove residue of the developer image from the belt, wherein the conductor is disposed upstream of the cleaning member in the moving direction of the belt.

7. The image forming apparatus according to claim 1, wherein the transfer member is configured to transfer the developer image on the photosensitive member to a recording sheet.

8. The image forming apparatus according to claim 1, wherein the belt is disposed such that the first surface is parallel to the second surface.

9. An image forming apparatus comprising:

a first roller and a second roller spaced apart from the first roller;

a belt being endless and extending around the first roller and the second roller, the belt being configured to move in a moving direction, the belt having a first surface and a second surface, the first surface extending from the first roller to the second roller in the moving direction, the second surface extending from the second roller to the first roller in the moving direction;

a photosensitive member disposed facing the first surface of the belt and configured to carry a developer image thereon;

a transfer member disposed facing toward the photosensitive member and configured to transfer the developer image on the photosensitive member;

a conductor electrically grounded and disposed facing the second surface of the belt;

a circuit board; and a board container configured to accommodate the circuit board therein, the board container including the conductor.

10. An image forming apparatus comprising:

a first roller and a second roller spaced apart from the first roller;

a belt being endless and extending around the first roller and the second roller, the belt being configured to move in a moving direction, the belt having a first surface and a second surface, the first surface extending from the first roller to the second roller in the moving direction, the second surface extending from the second roller to the first roller in the moving direction;

a photosensitive member disposed facing the first surface of the belt and configured to carry a developer image thereon;

a transfer member disposed facing toward the photosensitive member and configured to transfer the developer image on the photosensitive member;

a conductor electrically grounded and disposed facing the second surface of the belt; and a cleaning member configured to remove a-residue of the developer image from the belt, wherein the cleaning member includes the conductor on an upstream side in the moving direction of the belt.

* * * * *